United States Patent [19]

Kai et al.

[11] Patent Number: 4,659,206

[45] Date of Patent: Apr. 21, 1987

[54] PHOTOCONDUCTIVE DRUM DEVICE FOR ELECTROSTATIC COPYING MACHINES OR THE LIKE

[75] Inventors: Masami Kai; Shigeo Kurando, both of Osaka; Toshinobu Katafuchi, Hyogo; Katsumi Amakawa, Nara; Tetsuji Kajitani, Hyogo, all of Japan

[73] Assignee: Mita Industrial Co., Ltd., Osaka, Japan

[21] Appl. No.: 737,611

[22] Filed: May 23, 1985

[30] Foreign Application Priority Data

May 30, 1984 [JP] Japan ..... 59-110443

[51] Int. Cl.[4] ..... G03G 15/00; G03G 21/00

[52] U.S. Cl. ..... 355/3 DR; 219/469

[58] Field of Search ..... 355/3 R, 3 DR; 219/469, 219/470, 471

[56] References Cited

U.S. PATENT DOCUMENTS 3,349,221 10/1967 Schulze et al. ..... 355/3 R X
3,471,683 10/1969 Bogue ..... 219/469
4,161,357 7/1979 Herman et al. ..... 355/3 DR
4,297,562 10/1981 Kamogawa et al. ..... 219/471 X
4,301,359 11/1981 Ito et al. ..... 219/469

FOREIGN PATENT DOCUMENTS 55-53348 4/1980 Japan ..... 355/3 DR
57-8556 1/1982 Japan ..... 355/3 DR

*Primary Examiner*—Fred L. Braun
*Attorney, Agent, or Firm*—Jordan and Hamburg

[57] ABSTRACT

A photoconductive drum device for electrostatic copying machines or the like includes a temperature maintaining heater bent to a cylindrical form and accommodated in the main body of a photoconductive drum. The heater is constructed with a base plate and a heat generator attached to the base plate. The base plate has a parallelogrammatic form substantially corresponding to a shape which is obtained by cutting a hollow cylinder, having a diameter approximate to the inside diameter of the drum main body, along a helical cut line and unbending the cylinder.

6 Claims, 12 Drawing Figures

PHOTOCONDUCTIVE DRUM DEVICE FOR ELECTROSTATIC COPYING MACHINES OR THE LIKE

BACKGROUND OF THE INVENTION AND RELATED ART STATEMENT

The present invention relates to a photoconductive drum device for copying machines of the electrostatic record type or the like which is characterized by a heater accommodated in the photoconductive drum for maintaining the drum at a constant proper temperature.

Electrostatic record apparatus such as electrostatic copying machines comprise a photoconductive drum having a photoconductive layer over the surface. The drum is sensitized by a main charger while being rotated and thereafter exposed to an optical image to thereby form an electrostatic latent image on the photoconductive layer. The latent image is developed by a developing unit to a toner image, which is then transferred onto copy paper. The photoconductive material for use in such copying machines or the like is generally susceptible to the influence of temperature, so that it has been conventional practice to maintain the photoconductive layer at a constant temperature by a heater accommodated inside the drum.

FIGS. 11 (A) and (B) show one such conventional temperature maintaining heater. The illustrated heater 101 comprises a rectangular base plate 105 made of a resilient material such as stainless steel and bent into a hollow cylindrical form so as to be accommodated in a photoconductive drum 102. The base plate 105 is provided with a heat generator 106, for example, of nichrome wire extending in a zigzag pattern and fixed to one surface of the base plate. However, with the heater 101 wherein the base plate 105 is originally rectangular, the base plate 105 is liable to deform and scratch the edge of the drum 102 owing to its restoring force when the heater is inserted into the drum 102 while being bent into a cylindrical form against the restoring force. The heater is further very cumbersome to insert into the drum because the opposed longitudinal side portions thereof are displaced from each other and need to be correctly positioned after insertion. Additionally, when the heater is accommodated in the drum 102, it is difficult to hold the rectangular base plate 105 in the cylindrical bent form accurately along the inner surface of the drum 102. In fact, it is difficult to intimately fit the base plate 105 to the drum inner surface especially at the longitudinal side portions as seen in FIG. 11 (B). To assure intimate fitting contact, there arises a need to use fasteners (not shown) for pressing the base plate 105 against the drum inner surface. This makes the insertion procedure all the more cumbersome. When the heater 101 is accommodated in the drum 102, the straight portions of the heat generator 106 attached to the base plate 105 are arranged in parallel with the axis of the drum 102 and spaced at a distance circumferentially of the drum 102. Temperature irregularities are therefore liable to occur circumferentially of the drum, possibly resulting in irregularities in the transferred image. The temperature irregularities will be diminished if the portions of the heat generator 106 are arranged closely, but this renders the heater disadvantageous in respect of production process and cost.

It is required to control the temperature of the photoconductive drum with high precision when the photoconductive material used has temperature dependence.

Devices are known which comprise a temperature maintaining heater for heating the photoconductive drum, a temperature sensor, such as a thermistor, for detecting the temperature of the drum, and a control unit for controlling the amount of current to be passed through the heater in response to the temperature detection signal from the sensor. With the conventional device of this type, the temperature sensor is disposed at the longitudinal middle portion of the drum or an end portion thereof, but this leads to difficulty in properly controlling the overall temperature of the drum. When the drum is checked for longitudinal temperature distribution with the heater energized, it is seen that the drum has a low temperature at its opposite ends due to the release of heat from the flanges and also at the longitudinal middle portion where the copy paper removes heat during copying operation, the drum having the highest temperature at other portions. Accordingly, if the temperature sensor is disposed at the middle or end portion of the drum for controlling the temperature, the highest temperature portion becomes overheated resulting in the likelihood that the drum will deteriorate thermally or the toner supplied to the drum will be degraded.

SUMMARY OF THE INVENTION

A first object of the present invention is to provide a photoconductive drum device comprising a photoconductive drum and a temperature maintaining heater which is very easy to insert into the drum, intimately fittable to the drum inner surface as accommodated in the drum, and outstanding in its function because the drum can be heated with reduced temperature irregularities circumferentially thereof.

According to the present invention, the above-mentioned base plate has a parallelogrammatic form substantially corresponding to a shape which is obtained by cutting a hollow cylinder, having a diameter approximate to the inside diameter of the drum, along a helical cut line and unbending the cylinder, so that the base plate can be inserted into the drum very easily by being bent into a cylindrical form and is fittable to the drum inner surface very intimately. Further, when the base plate is thus inserted in the drum, the heat generator of the heater extends substantially in parallel with the helical side edge of the base plate, with the result that the drum can be heated with reduced temperature variations circumferentially thereof to preclude irregularities in the transferred image even if the portions of the heat generator are arranged relatively coarsely. The photoconductive drum is therefore advantageous in respect of production process and function.

A second object of the present invention is to provide a photoconductive drum device of the type described wherein the temperature of the drum is controlled according to a detection signal from a temperature sensor which is positioned properly in view of the longitudinal temperature distribution of the drum during its operation so as to assure precise temperature control by the detected drum temperature without entailing thermal deterioration and variation of sensitivity.

According to the invention, a temperature maintaining heater and a temperature sensor are provided in the interior of a photoconductive drum, and the temperature sensor is disposed approximately at the midportion between a low temperature portion of the drum and a highest temperature portion thereof, whereby the entire drum can be controlled to a proper temperature to prevent the deterioration or sensitivity variation of the drum due to excessive local rise of temperature.

DETAILED DESCRIPTION OF PREFERRED EMBODIMENTS

Figure 1:
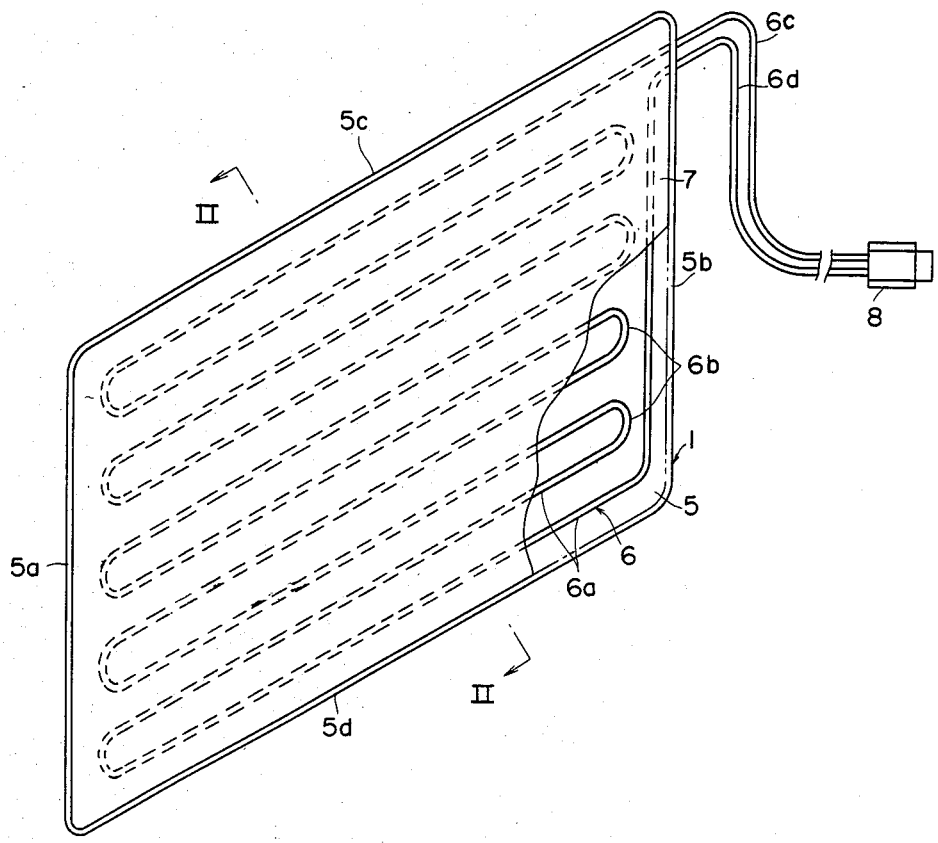
FIG. 1 is a plan view partly broken away and showing a temperature maintaining heater included in an embodiment of a photoconductive drum device of the present invention, the heater being shown in development.

The present invention provides a photoconductive drum device which comprises a cylindrical photoconductive drum provided with a photoconductive layer over its surface, and a temperature maintaining heater including a base plate made of a resilient material and a heat generator provided on one surface of the base plate, the base plate having a parallelogrammatic form substantially corresponding to a shape which is obtained by cutting a hollow cylinder having a diameter approximate to the inside diameter of the drum along a helical cut line and unbending the cylinder, the heat generator having a plurality of straight portions arrranged at a specified spacing substantially in parallel with the side edge of the base plate along the cut line, the heater being bent to a cylindrical form and accommodated in the photoconductive drum.

The present invention further provides a photoconductive drum device which comprises a temperature maintaining heater for heating a photoconductive drum, a temperature sensor for detecting the temperature of the drum, and a current control unit for controlling the amount of current to be passed through the heater according to a detection signal from the sensor, the heater and the sensor being provided in the interior of the drum, the position of the sensor relative to the drum with respect to the longitudinal direction thereof being approximately in the middle between a highest temperature portion of the drum and a portion thereof having a low temperature due to the removal of heat by copy paper during the operation of the drum.

Embodiments will be described below.

FIGS. 1 to 6 show a temperature maintaining heater 1 of the present invention, and a photoconductive drum 2. The drum 2 comprises a cylindrical main body 2*a*, a photoconductive layer 2*b* formed over the surface of the main body, a flange 3 at each end and a shaft 4. The present device is assembled by accommodating the heater 1 in the main body 2*a* and thereafter attaching the flanges 3 and the shaft 4 to the main body and is incorporated into an unillustrated electrostatic record apparatus such as an electrostatic copying machine. The heater 1, which is adapted for heating the drum 2 at a specified temperature, comprises a base plate 5 and a heat generator 6 attached to one surface of the base plate.

Figure 2:
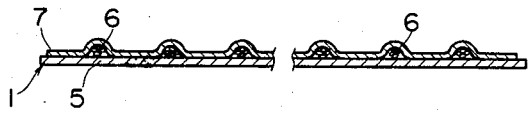
FIG. 2 is an enlarged view partly broken away and in section taken along the line II—II in FIG. 1.

As seen in FIGS. 1 and 2, the base plate 5 of the heater 1 is initially prepared in a parallelogrammatic form substantially corresponding to a shape which is obtained by cutting a hollow cylinder, having a diameter approximate to the inside diameter of the drum main body 2*a*, along a helical cut line having a given lead angle and unbending the cut cylinder. Stated more specifically with reference to FIG. 1, the left and right sides 5*a*, 5*b* of the base plate 5 have a length approximately equal to the inner circumference of the drum main body 2*a*, and the upper and lower sides 5*c*, 5*d* of the plate have a length approximate to the length of the cut line. With respect to a direction perpendicular to the left and right sides 5*a*, 5*b*, the upper and lower sides 5*c*, 5*d* are inclined by a predetermined angle. Preferably, the base plate 5 is made of a resilient material having a great restoring force and high heat conductivity and smoothly slidingly insertable into the drum 2, such as stainless steel.

The heat generator 6 is made of nichrome wire or the like covered with an insulator and comprises straight portions 6*a* arranged at a specified spacing substantially over the entire base plate 5 on one surface thereof and interconnected by fold portions 6*b* in a zigzag pattern. The heat generator 6 is fixedly held between the base plate 5 and a cotton fabric 7 adhered to the above-mentioned one surface thereof. The straight portions 6*a* of the heat generator 6 are arranged approximately in parallel with the upper and lower sides 5*c*, 5*d* of the base plate 5 as shown in FIG. 1. Both ends 6*c*, 6*d* of the heat generator 6 extend outward from the base plate 5 and are attached to a connector 8 for connection to a power supply.

Figure 3:
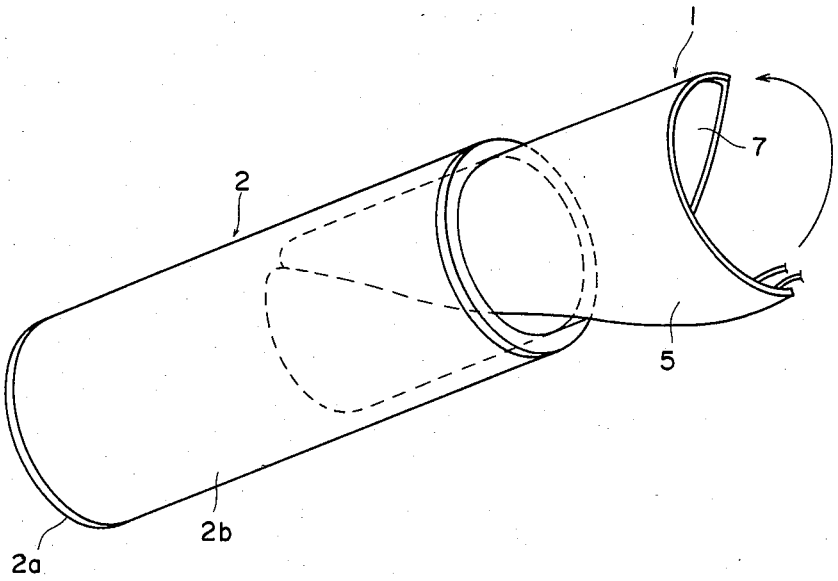
FIG. 3 is a perspective view showing the heater while it is being inserted into a photoconductive drum.
Figure 4:
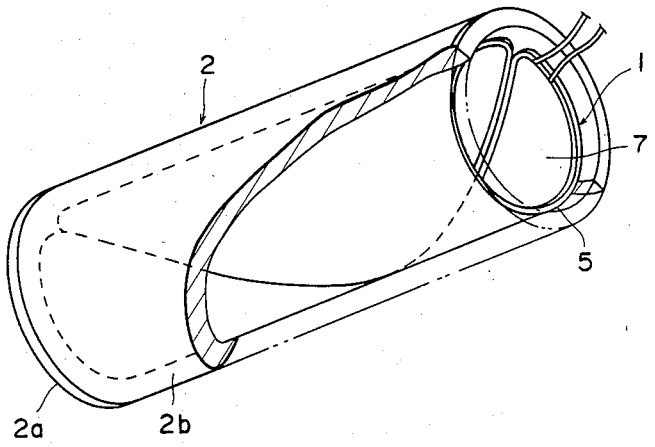
FIG. 4 is a perspective view partly broken away and showing the heater as inserted in the drum.
Figure 5:
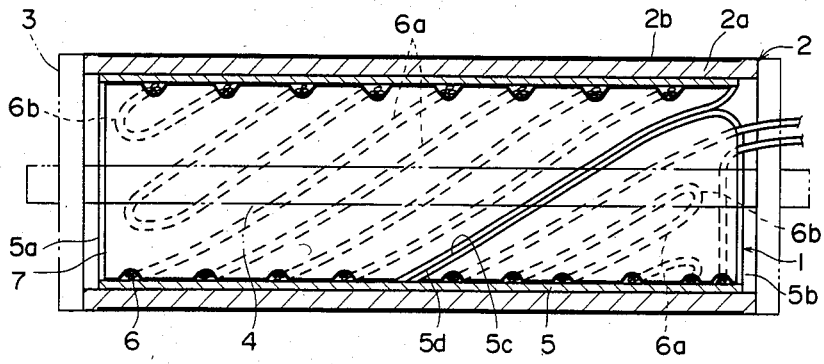
FIGS. 5 and 6 are views showing the assembly in cross-section along the drum axis and in cross-section perpendicular to the axis, respectively.
Figure 6:
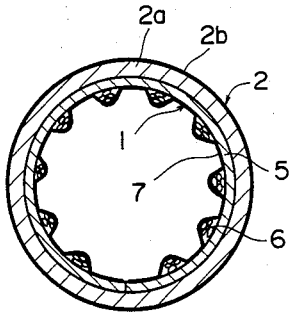
Figure 7:
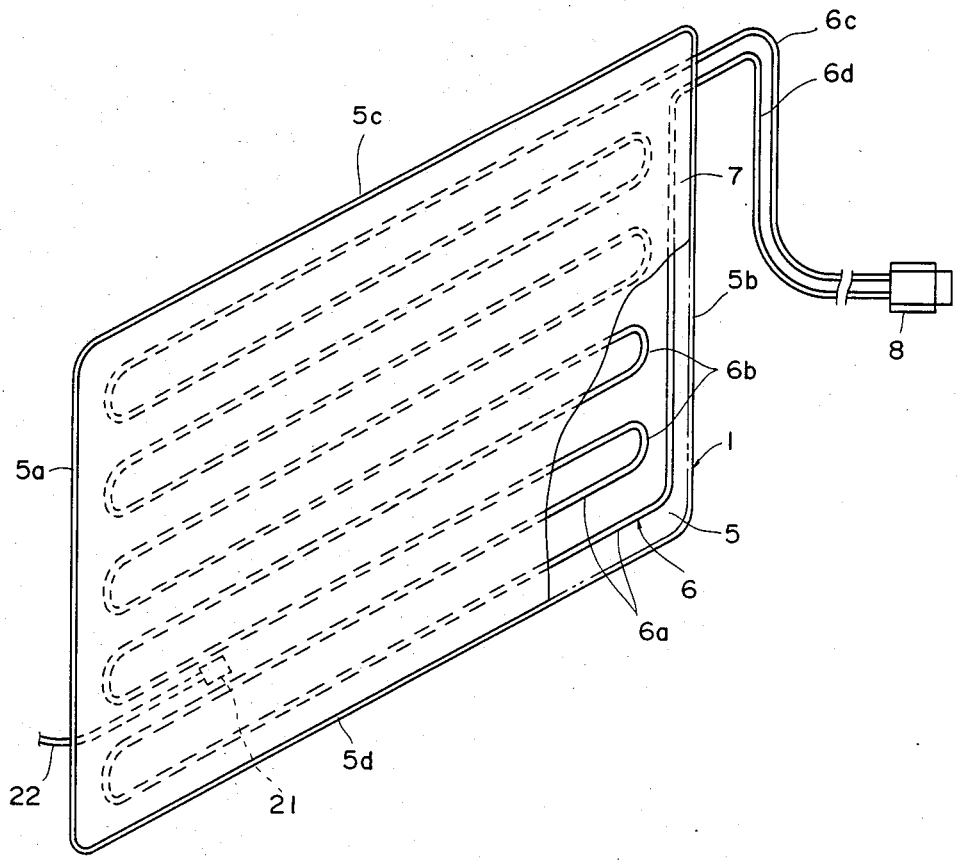
FIG. 7 is a plan view partly broken away and showing a temperature maintaining heater included in another embodiment of a photoconductive drum device of the invention, the heater being shown in development.
Figure 8:
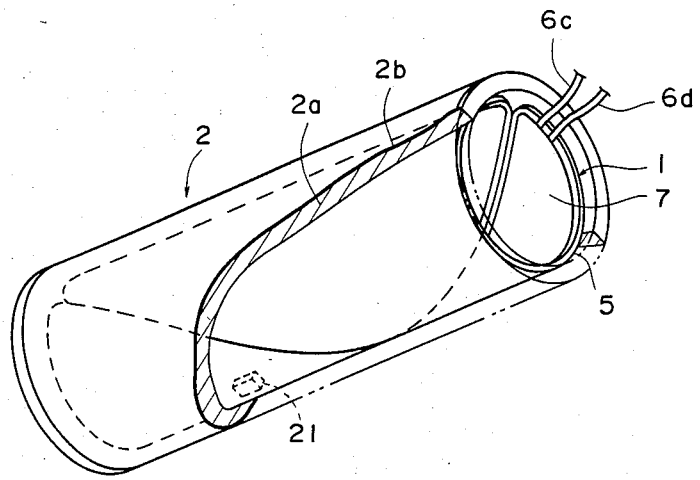
FIG. 8 is a perspective view partly broken away and showing the heater of FIG. 7 as it is inserted in a photoconductive drum.
Figure 9:
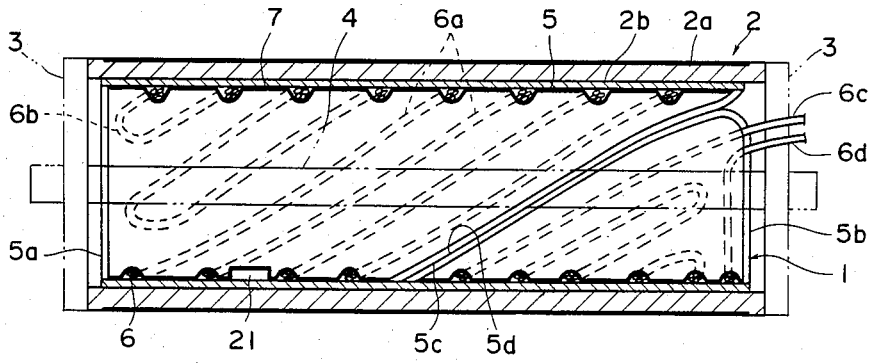
FIG. 9 is a longitudinal cross-sectional view showing the device of FIG. 8.
Figure 11:
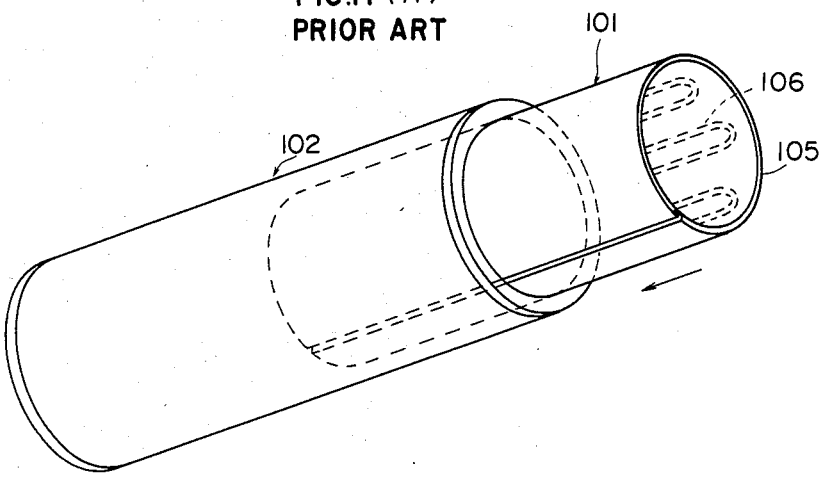
FIG.11 (A) PRIOR ART
FIGS. 11 (A) and (B) are a perspective view and a sectional view showing a conventional device.
Figure 11:
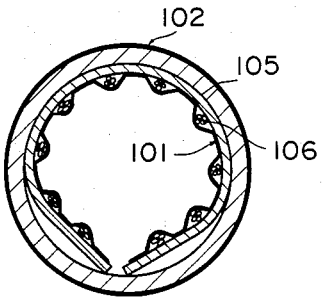
FIG.11 (B) PRIOR ART

Because the base plate 5 is parallelogrammatic, the heater 1 thus constructed can be very easily and smoothly accommodated into the drum 2 by inserting the base plate 5 into the drum main body 2*a* with the heat generator bearing side thereof positioned inside, while bending and twistingly rotating the base plate 5 in the direction of arrow as shown in FIG. 3. The base plate 5 can be shaped properly while being inserted in this way, with the result that when the heater is inserted in the drum main body 2*a*, the base plate 5 is held in a bent cylindrical form accurately along the inner surface of the drum main body 2*a* as seen in FIGS. 4 to 6 without the necessity of shaping the plate after insertion. With the opposed sides 5*c*, 5*d* twisted helically in this state, these side portions are also subject to bending action, so that the base plate is fittable to the drum inner surface more intimately than when the conventional rectangular base plate is bent (see FIG. 11). Since the base plate 5 can be retained in this state by its own restoring force, there is no need to use fasteners or the like. Accordingly the heater 1 is easy to insert into and attached to the drum 2.

With the heater 1 thus accommodated in the drum 2, the heat generator 6 has its straight portions 6*a* arranged in a direction inclined at a given angle with respect to the drum axis. This serves to reduce temperature irregularities circumferentially of the drum 2.

Another embodiment of the present invention will be described with reference to FIGS. 7 to 10. Throughout FIGS. 1 to 10, the same parts are referred to by the same reference numerals. According to this embodiment, a temperature sensor 21 comprising a thermistor or the like is fixedly provided between the base plate 5 and the cotton fabric 7 of the temperature maintaining heater 1 and is provided in the interior of the drum main body 2*a* along with the heater 1. The sensor 21 is connected by a lead wire 22 to a current control unit for the heater 1. The amount of current to be passed through the heater 1 is controlled according to a detection signal from the sensor 21.

Figure 10:
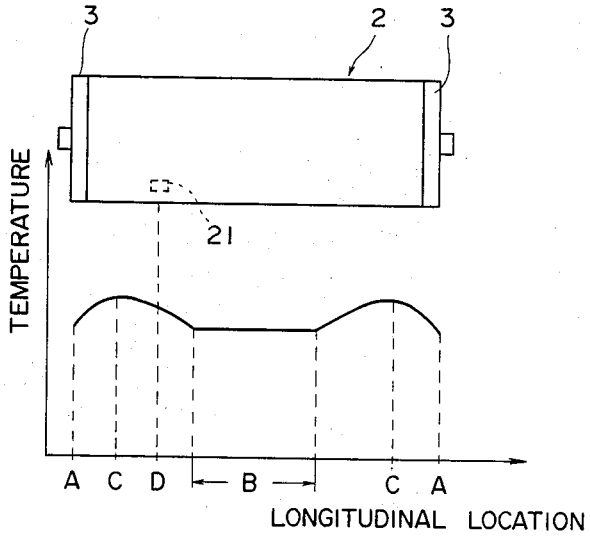
FIG. 10 is a schematic diagram showing the longitudinal temperature distribution of the drum device and the location where a temperature sensor is disposed.

The position of the sensor 21 relative to the drum 2 with respect to the longitudinal direction thereof is predetermined based on the longitudinal temperature distribution to be produced while the drum 2 is in operation as heated by the heater 1. The sensor 21 is disposed approximately at the midportion between a highest temperature portion of the drum and a portion thereof having a low temperature due to the removal of heat by the copy paper. This will be explained with reference to a case wherein copy paper is fed to the drum 2 as centered thereon. As shown in FIG. 10, the drum 2 has a low temperature at its longitudinally opposite end portions A due to the release of heat from the flanges 3 and also at the longitudinal middle portion B where the copy paper removes heat. Thus, there is a portion C of the highest temperature between the central low temperature portion B and each end portion A. In this case, therefore, the sensor 21 is disposed approximately at the midportion D between the central low temperature portion B and one of the highest temperature portions C.

The temperature sensor 21 thus positioned assures the drum 2 of proper temperature control. If the sensor is provided at the longitudinal middle portion or end portion of the drum 2 to maintain the set temperature at this sensor position as conventionally practiced, the highest temperature portion becomes overheated, entailing various objections as described in detail with reference to the prior art. Further, if the sensor is disposed at the highest temperature portion, the temperature of the longitudinal middle portion becomes too low when the copying cycle is repeated, with the likelihood that the photoconductive layer 2*b* will be unable to retain the proper sensitivity at this portion. In contrast, when the sensor 21 is provided approximately at the midportion D between the central low temperature portion B and the highest temperature portion C of the drum 2, the longitudinally average temperature is detected, and the difference between the detected temperature and the temperature at the highest temperature portion C, as well as at the central low temperature portion B, is small, whereby excessive local rise or fall of temperature can be prevented. This serves to maintain the drum at a uniform temperature longitudinally thereof within the proper range.

Because the temperature sensor 21 is disposed in the interior of the drum 2 and attached to the heater 1 which is intimately fitted to the inner surface of the drum main body 2*a*, errors due to atmospheric influence are avoidable. Further, because use of the heater 1 ensures reduced temperature variations circumferentially of the drum, the temperature of the overall drum 2 is controllable more properly by the combination of the heater and the sensor 21 which is positioned as above.

In the case of copying machines, etc. of the type wherein the copy paper is fed to the drum 2 as positioned in place with respect to the side, the longitudinal temperature distribution involved differs from that shown in FIG. 10. In this case, the portion where the copy paper is fed has a low temperature, and there is other portion which has the highest temperature, so that the sensor is to be disposed approximately at the midportion between these portions.

What is claimed is:

1. A photoconductive drum device for electrostatic copying machines or the like comprising a cylindrical photoconductive drum having a hollow interior and an outer surface comprising a photoconductive layer, and a temperature-maintaining heater comprising a base plate made of a resilient material and a heat generator provided on one surface of the base plate, the base plate having a parallelogrammatic form substantially corresponding to a shape obtained by cutting a hollow cylinder having a diameter approximate to an inside diameter of the drum along a helical cut line and unbending the hollow cylinder, the heat generator having a plurality of straight portions arranged at a specified spacing substantially in parallel with a side edge of the base plate defined by the helical cut line, the heater being bent to a cylindrical form and accommodated in the hollow interior of the photoconductive drum.

2. A photoconductive drum device as defined in claim 1 wherein the base plate is made of stainless steel.

3. A phtoconductive drum device as defined in claim 1 wherein the temperature maintaining heater is accommodated in the drum by bending and twistingly rotating the base plate into the hollow interior of the drum with said one surface of the base plate facing inwardly of the drum.

4. A photoconductive drum device as defined in claim 1 further comprising a temperature sensor disposed in the hollow interior of the photoconductive drum for detecting a temperature of the drum, and a current control unit for controlling an amount of current to be passed through the heater according to a detection signal from the sensor.

5. A photoconductive drum device as defined in claim 4 wherein the temperature sensor is disposed in the drum with respect to a longitudinal direction thereof approximatly in the middle between a highest temperature portion of the drum and a portion of the drum having a lower temperature due to removal of heat by copy paper during operation of the drum.

6. A photoconductive drum device as defined in claim 4 wherein the temperature sensor is disposed within the temperature-maintaining heater.

* * * * *